United States Patent [19]

Silberman et al.

[11] Patent Number: 4,624,457

[45] Date of Patent: Nov. 25, 1986

[54] PORTABLE WALL MOUNTED EXERCISE UNIT

[75] Inventors: Ira J. Silberman, Opelika; William J. Hill, Lanett, both of Ala.

[73] Assignee: Diversified Products Corporation, Opelika, Ala.

[21] Appl. No.: 270,334

[22] Filed: Jun. 4, 1981

Related U.S. Application Data

[63] Continuation-in-part of Ser. No. 231,327, Feb. 4, 1981, abandoned.

[51] Int. Cl.[4] ..... A63B 21/06

[52] U.S. Cl. ..... 272/118; 272/134

[58] Field of Search ..... 272/62, 63, 93, 116–118, 272/134, 136–145, DIG. 4, 123; 182/206

[56] References Cited

U.S. PATENT DOCUMENTS

| | | | |
|---|---|---|---|
| Re. 28,066 | 7/1974 | Marcyan . | |
| 403,703 | 5/1889 | Small | 272/118 |
| 457,400 | 8/1891 | Dowd | 272/118 |
| 676,771 | 6/1901 | Reach | 272/118 |
| 931,699 | 8/1909 | Medart | 272/118 |
| 1,019,861 | 3/1912 | Titus | 272/138 |
| 2,632,645 | 3/1953 | Barkschat | 272/118 X |
| 2,767,032 | 10/1956 | Mitchell | 182/206 X |
| 2,783,045 | 2/1957 | Bosch | 272/62 X |
| 2,977,120 | 3/1961 | Morris | 272/118 |
| 3,003,765 | 10/1961 | Dove . | |
| 3,207,512 | 9/1965 | Kinsey | 272/118 X |
| 3,235,255 | 2/1966 | Leflar . | |
| 3,346,256 | 10/1967 | White . | |
| 3,373,993 | 3/1968 | Oia et al. | 272/118 |
| 3,438,627 | 4/1969 | La Lanne . | |
| 3,557,906 | 1/1971 | Gutner | 182/206 |
| 3,627,315 | 12/1971 | Marcyan . | |
| 3,635,472 | 1/1972 | Marcyan | 272/118 |
| 3,743,282 | 7/1973 | Zinkin . | |
| 3,746,338 | 7/1973 | Proctor . | |
| 3,840,227 | 10/1974 | Chesemore | 272/118 |
| 3,905,599 | 7/1975 | Mazman . | |
| 3,912,263 | 10/1975 | Yatso | 272/118 |
| 3,971,555 | 7/1976 | Mahnke . | |
| 4,010,947 | 3/1977 | Lambert, Sr. . | |
| 4,185,816 | 1/1980 | Bernstein | 272/900 |
| 4,199,139 | 4/1980 | Mahnke et al. | 272/118 |
| 4,200,280 | 4/1980 | Goodwin . | |
| 4,243,219 | 1/1981 | Price | 272/117 |
| 4,317,566 | 3/1982 | Uyeda et al. . | |

FOREIGN PATENT DOCUMENTS

| | | | |
|---|---|---|---|
| 51407 | 7/1974 | Australia . | |
| 58943 | 12/1980 | Australia . | |
| 78754 | 8/1893 | Fed. Rep. of Germany . | |
| 1003973 | 11/1951 | France | 272/118 |
| 1140902 | 4/1957 | France . | |
| 80/02508 | 11/1980 | PCT Int'l Appl. . | |
| 728787 | 4/1955 | United Kingdom | 272/113 |
| 1151656 | 5/1969 | United Kingdom . | |

OTHER PUBLICATIONS

"Marcy" Catalogue; 1974; pp. 20–24.

Catalog of Gymnasium Apparatus–Fred Medart Manufacturing Co., p. 32, 1926.

Catalog of Gymnastic Apparatus–Narragansett Machine Co., p. 24, 1925.

Marcy Physical Fitness Program, 1980, and insert on p. 3.

*Primary Examiner*—Richard J. Apley

*Assistant Examiner*—Robert W. Bahr

*Attorney, Agent, or Firm*—Banner, Birch, McKie & Beckett

[57] ABSTRACT

A guided weight exercise device has a lower anchor arrangement for readily attaching the lower portion of the device to a supporting wall by pivotal movement of the device about a floor-engaging support upwardly from a slanted position with the lower portion of the unit adjacent the wall. Reverse pivotal movement of the device detaches it from the wall. The floor-engaging support may be a wheel assembly. The guide assembly for the weights comprises a pair of spaced parallel guide bars each having separate upper and lower bar sections, and a coupling which interconnects the guide bars and joins their upper and lower sections. The weight is lifted by a guided carriage and an arrangement of upper and lower sheaves and a cable. The sheaves and cable are located adjacent the wall and completely behind the carriage and the guide bars. The upper sheave is pivoted about a vertical axis, and both upper and lower sheaves are located medially of the guide bars so that the cable can extend away from the device from between the guide bars.

12 Claims, 12 Drawing Figures

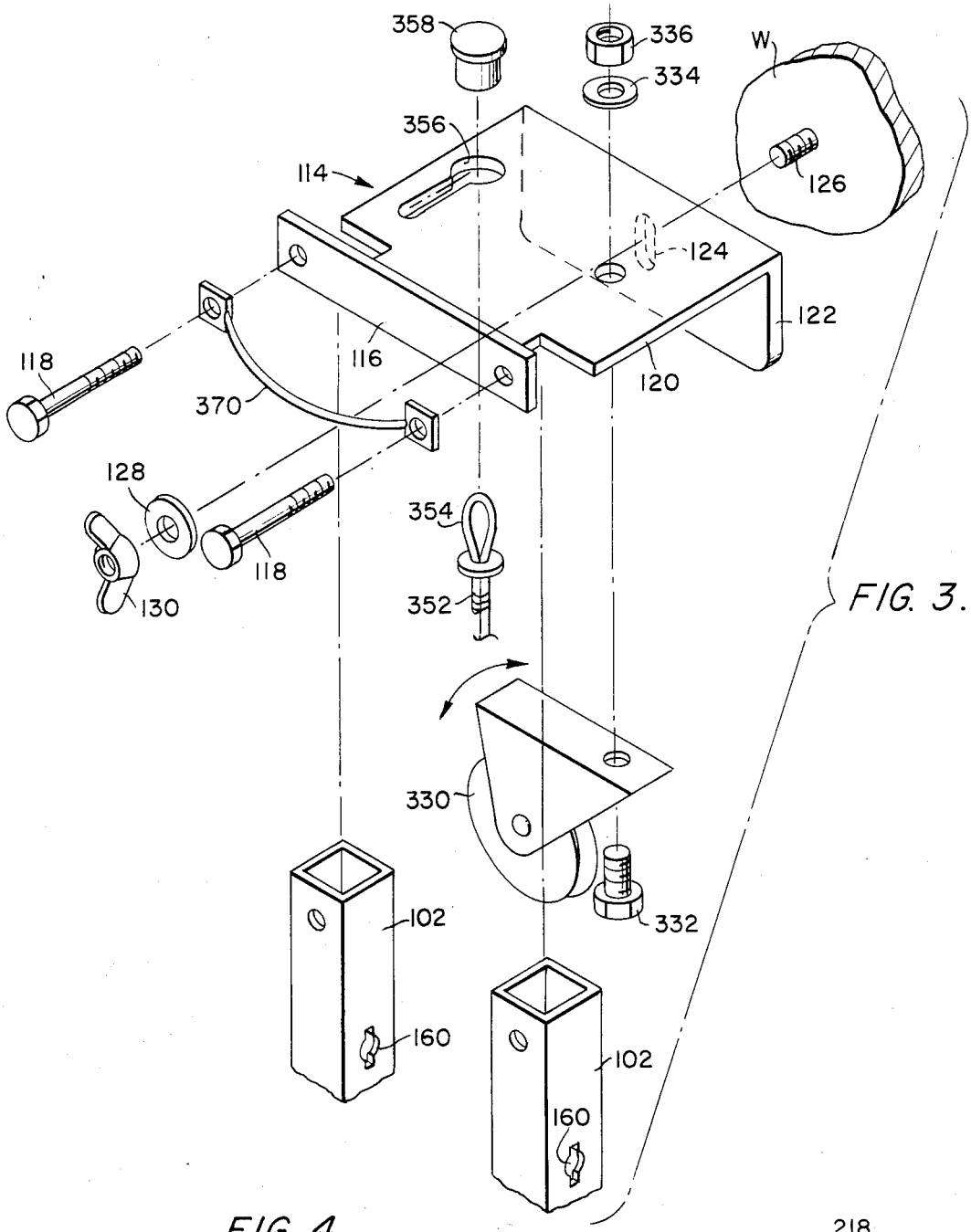
FIG. 3.
FIG. 4.
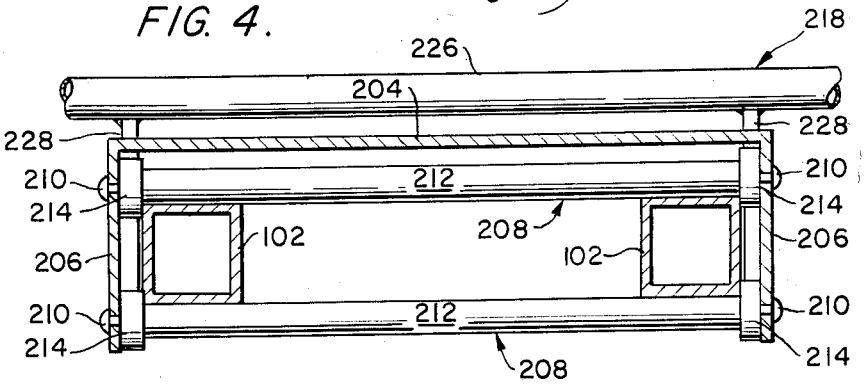

PORTABLE WALL MOUNTED EXERCISE UNIT

This application is a continuation-in-part of application Ser. No. 231,327, filed Feb. 4, 1981 now abandoned.

BACKGROUND OF THE INVENTION

1. Field of the Invention

The present invention relates to exercise devices for developing and conditioning various parts of the body and, more particularly, to a portable, compact weight lifting exercise unit.

2. Description of the Prior Art

The importance of regular exercise for building and maintaining strength and endurance cannot be overemphasized. The modern conveniences which we enjoy and the sedentary tasks which we increasingly perform have given us a comfortable life style at the expense of physical fitness. Highly active exercise programs, such as running, develop endurance of the cardiovascular system. Muscular strength and endurance is best developed through weight training.

The simplest and least expensive apparatus for weight training is the barbell with removable weights. However, the use of the barbell alone cannot develop all areas of the body. Hence, additional apparatus must be employed for a comprehensive conditioning program. Devices developed for this purpose generally provide the user with a force resister against which muscular effort must be applied. Resistance is typically provided by a weight and pulley arrangement, or by an elastic element. These devices permit the force to be applied to the user's body from many different directions in order to develop substantially all areas of the body.

Few of these weight training devices, however, can provide the user with substantially all of the exercising variants required to develop the entire body. Those that do are generally large, complex and costly machines which occupy a substantial amount of space, and consequently are not suitable for home use. These are usually found only in health clubs and other athletic establishments. Devices specifically designed for home use, while somewhat smaller, usually must be permanently erected in a room or location specifically set aside for exercising. Many homes do not have sufficient space for this purpose. Hence, a need exists for a compact and versatile exercise unit which can be easily erected for use and removed for storage.

SUMMARY OF THE INVENTION

Accordingly, it is an object of the present invention to obviate the above noted disadvantages of the prior art by providing a simple, compact and inexpensive exercising apparatus for performing a complete range of weight training exercises.

Another object of the invention is to provide such an apparatus which is readily demountable from its wall supported position, and easily transportable to a place of storage.

Another object of the invention is to provide such an apparatus which can be shipped in one or more packages of manageable size, and assembled by the consumer.

Another object of the invention is to provide such an apparatus which can be used to perform a full range of exercises in a minimum amount of space.

These and other objects of the present invention are accomplished by providing an exercise unit adapted to be detachably secured to a wall during use, the unit having at least one liftable weight, upright guide means for guiding the weight during lifting, lifting means engagable by a user and operatively connected to the weight for raising and lowering the weight, and floor-engaging support means, preferably in the form of wheel means journalled on the unit adjacent the bottom of the guide means, for supporting the unit and facilitating transportation thereof when detached from the wall.

Quick connection and disconnection from the wall is provided by lower anchor means attached to the lower portion of the unit for anchoring the lower portion of the unit to the wall by pivotal movement of the unit upwardly about the wheel means to an upright position of use, and permitting detachment of the unit from the wall by pivotal movement of the unit downwardly from its upright position.

The weight or weights are supported in their lowest rest position by a platform supported by the guide means above its bottom. The space beneath the platform accommodates the wheel means and a lower sheave for guiding a cable for performing "low pull" exercises, and the lower anchor means. An upper sheave is provided for performing "high pull" exercises through a cable. The guide means preferably comprises two spaced, parallel guide bars, each of which is formed in upper and lower bar sections which are coupled together during assembly by coupling means which interconnects the guide bars and the upper and lower bar sections. Preferably the upper sheave is pivoted about a vertical axis located medially of the guide bars. The upper and lower sheaves and the cable are located adjacent the wall and completely behind the guide bars.

BRIEF DESCRIPTION OF THE DRAWINGS

The novel features of the invention are set out with particularity in the appended claims, but the invention will be understood more fully and clearly from the following detailed description of the invention as set forth in the accompanying drawings, in which:

FIG. 3 is an exploded view of the upper portion of the guide means and the wall bracket therefor;

FIG. 4 is a sectional view of the unit taken along line 4—4 of FIG. 2;

DETAILED DESCRIPTION OF THE PREFERRED EMBODIMENTS

Figures 1, 2:
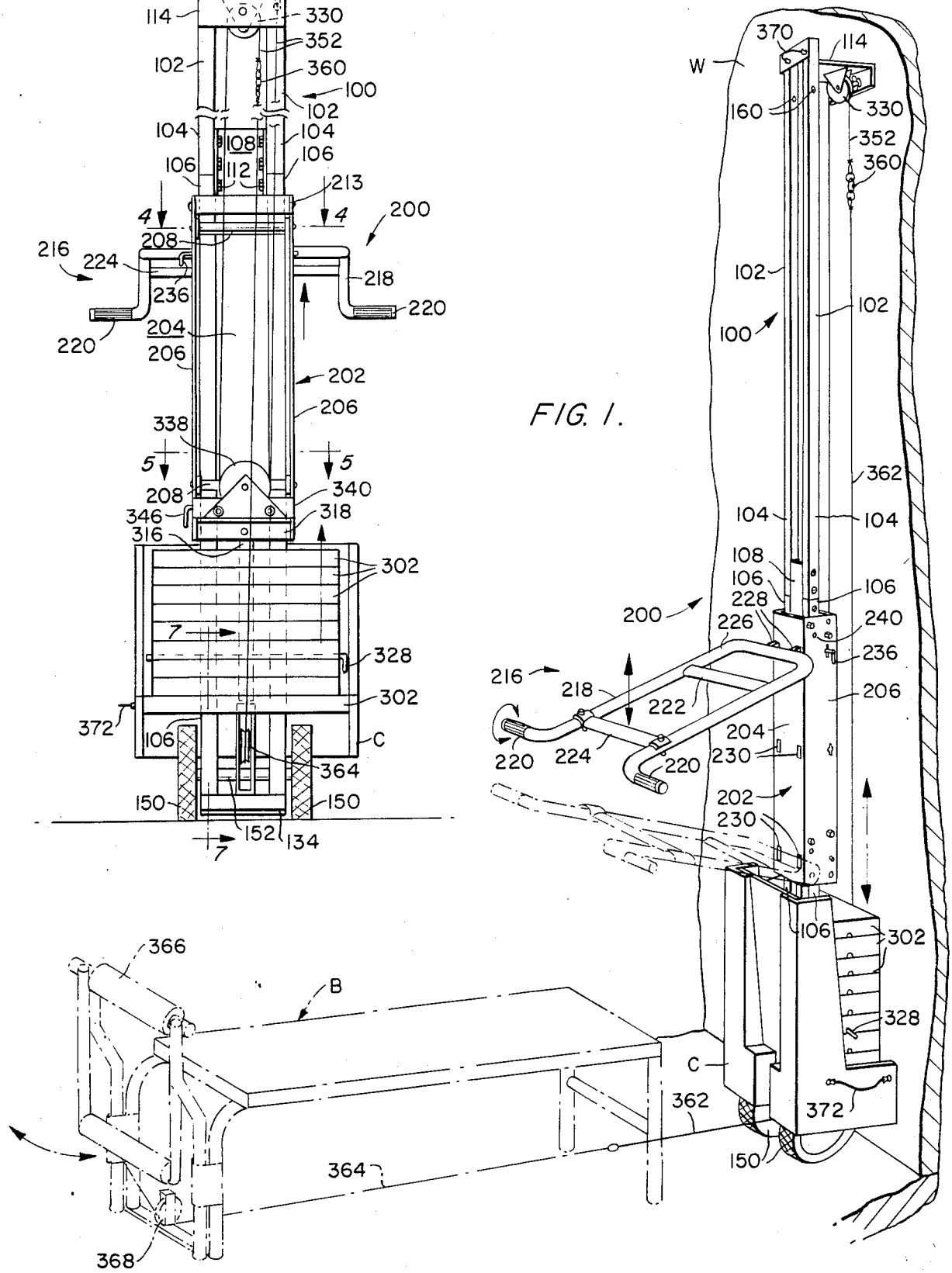
FIG. 1 is a perspective view of the exercise unit according to the invention.
FIG. 2 is a rear elevational view thereof.

Referring to FIGS. 1 and 2, the exercise unit of the invention generally comprises an upright guide bar frame 100 for guiding weights 302 lifted by a carriage and handle assembly 200, which is also guided along guide bar frame 100. Guide bar frame 100 is secured to a wall W or other vertical supporting surface at the top and bottom portions of the unit, as described in detail below.

Guide bar frame 100 comprises two parallel guide bars 102 of generally square cross section fabricated in upper and lower guide bar portions 104 and 106, respectively. Fabrication of guide bars 102 in these shorter sections, which are roughly one half the height of the assembled unit, permits the unit to be packaged and shipped in one or more cartons of manageable size. Upper and lower guide bar sections 104 and 106 are joined together by a U-shaped spacer bracket 108 which spans the joints between the sections and is fastened to each of the sections by bolts 110 and nuts 112. These joints are reinforced by tubular inserts (not shown) which are received within guide bars sections 104 and 106 and are simultaneously bolted in place by bolts 110.

Figure 7:
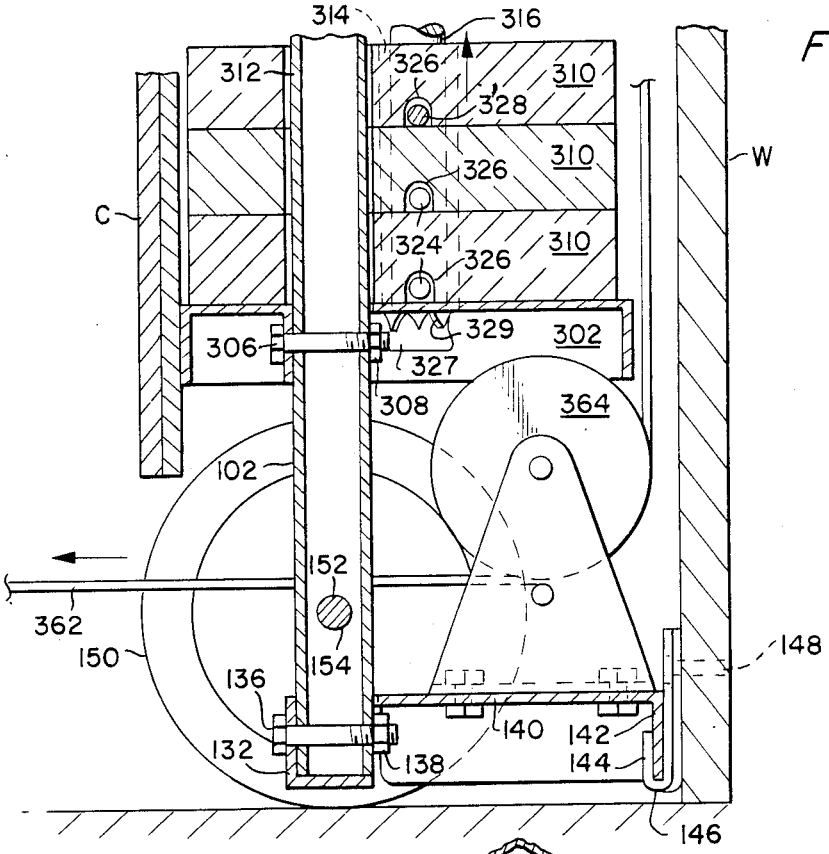
FIG. 7 is a partial sectional view of the unit taken along line 7—7 of FIG. 2.
Figure 8:
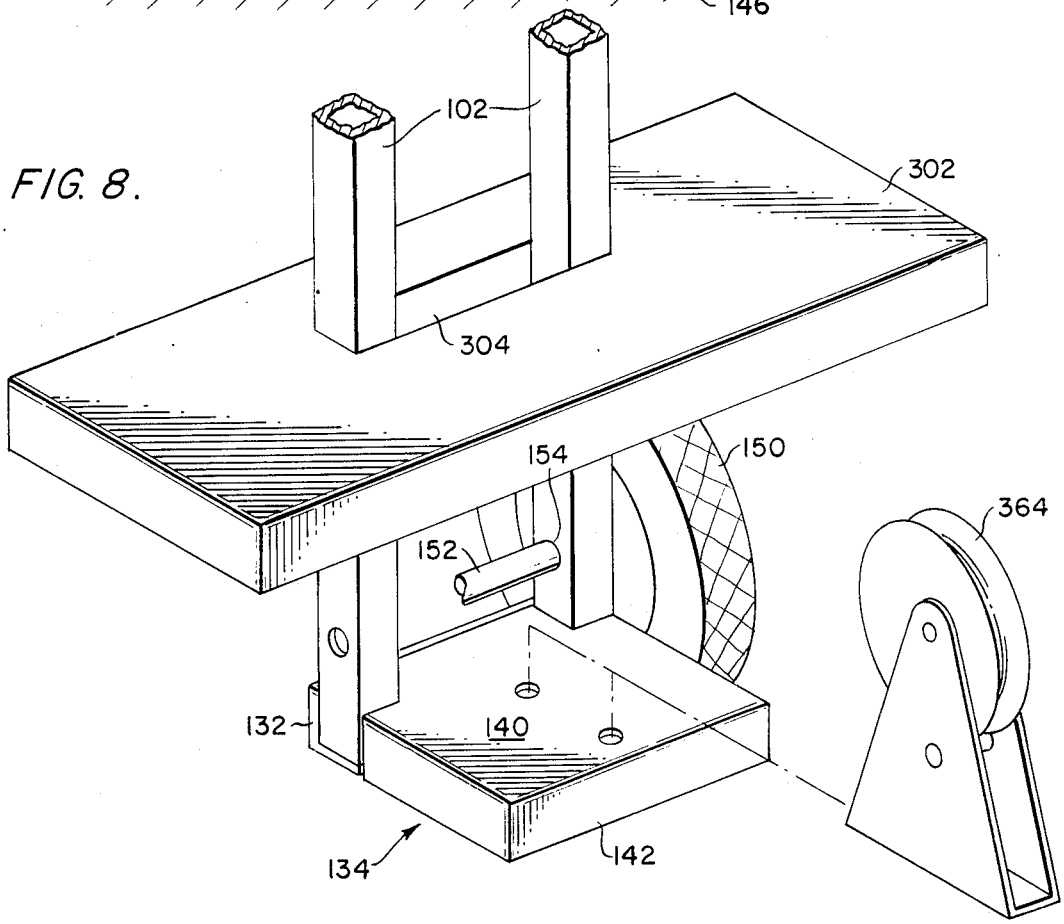
FIG. 8 is a perspective view, with parts removed, of the lower portion of the unit.

The upper ends of guide bars 102 are secured to a top bracket 114 (FIG. 3). Bracket 114 has an apertured vertical front flange 116 to which guide bars 102 are bolted by bolts 118. Bracket 114 also has a flat portion 120 extending rearwardly from flange 116, and a depending flange 122 having an aperture 124 through which the top of the unit is secured to wall W by a stud 126 fastened to the wall, a washer 128 and a wing nut 130. The bottom ends of guide bars 102 are fastened (FIGS. 7 and 8) to the front flanges 132 of a lower bracket 134 by bolts 136 and nuts 138. Lower bracket 134 has a central flat portion 140 and a depending rear flange 142. Rear flange 142 is adapted to be secured to the wall W by engagement with the upstanding flange 144 of a J-shaped bracket 146 fastened to the wall by screws 148 or the like.

The entire exercise unit is supported by a pair of wheels 150 which are journalled on an axle 152 received in apertures 154 formed in the lower portions of guide bars 102. The wheels enable the unit to be transported with ease by merely rolling the unit across the floor. This is particularly advantageous in situations where the unit cannot be permanently installed. Hence, the unit can be wheeled from a stored position in a closet or the like to its location of use. The unit is quickly and easily secured to the wall W by positioning the lower end of the unit near the wall in front of bracket 146 and rotating the unit upwardly so that depending flange 142 of bracket 134 moves downwardly behind flange 144 of bracket 146. The top end of the unit is then quickly secured to stud 126 by wing nut 130. Removal for storage is accomplished in the reverse order.

Figure 5:
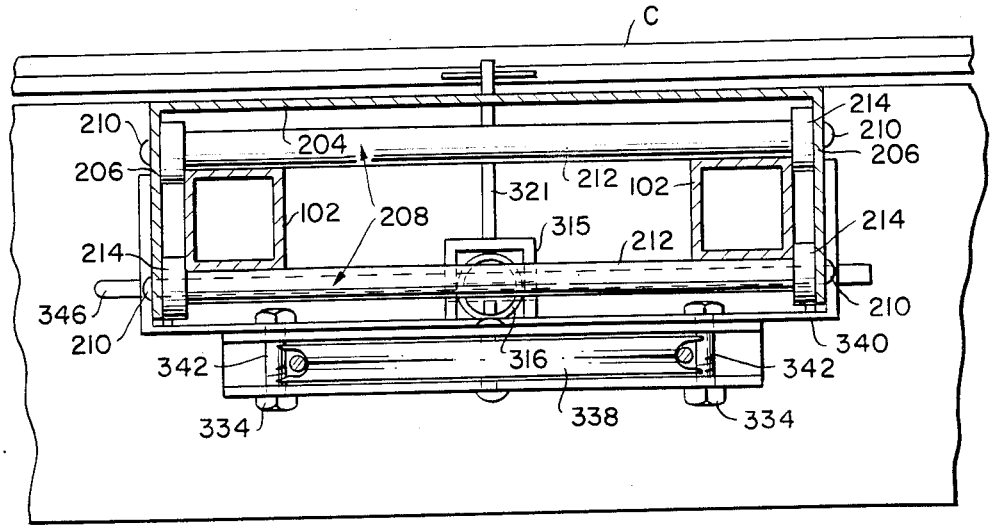
FIG. 5 is a sectional view of the unit taken along line 5—5 of FIG. 2.
Figure 6:
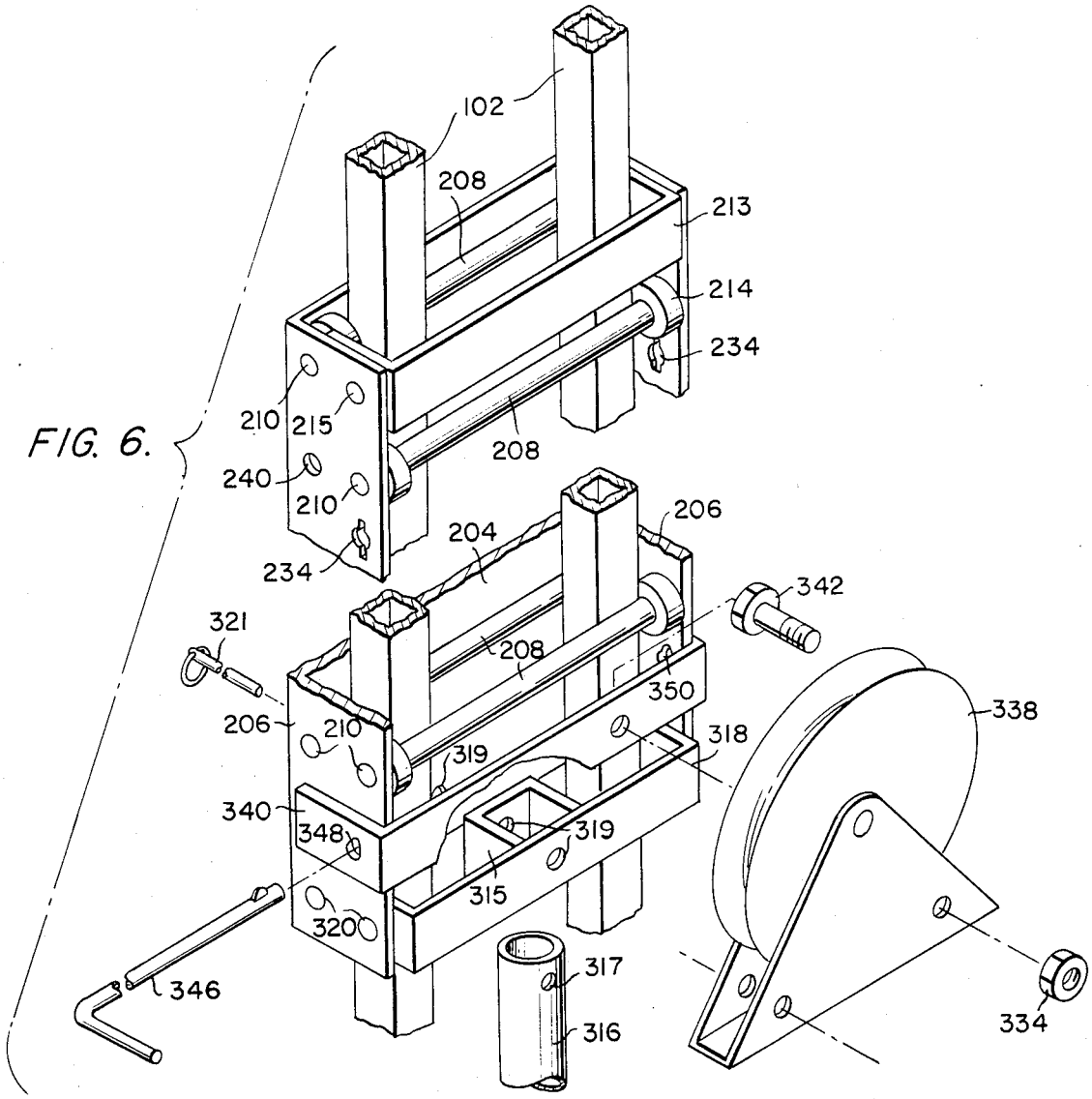
FIG. 6 is an exploded view of the liftable carriage assembly of the unit.

Carriage assembly 200 comprises a channel-shaped frame 202 having a front face 204 and side members 206 which extend rearwardly along the sides of guide bars 102. Upper and lower pairs of rollers 208 (FIGS. 4, 5 and 6) are journalled on axles 210 carried by side members 206. Rollers 208 have reduced diameter central portions 212 which engage the front and rear surfaces of guide bars 102, and enlarged end portions 214 which engage the outboard surfaces of guide bars 102 to prevent lateral shifting of the carriage. The upper end of carriage 202 is strengthened by a stiffener bracket 213 which spans side members 206 and is secured thereto by bolts 215, rivets or the like.

Figure 9:
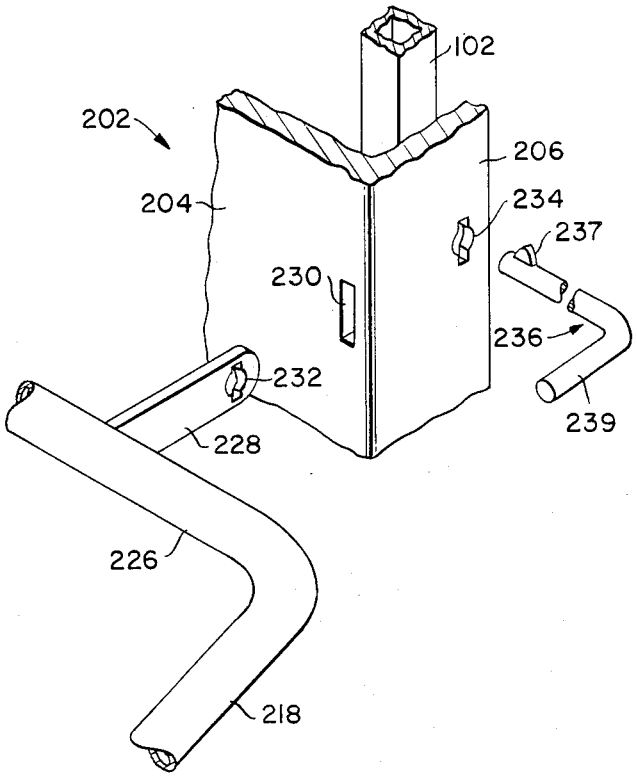
FIG. 9 is an exploded view of a portion of the carriage assembly of the unit, showing the interconnection of the handle with the carriage.

A handle 216 may be adjustably secured to carriage 202 at various "starting" heights. That is, the selected height of handle 216 is determined by the height of the user and his initial body position when performing a particular exercise. Bench presses, for example, would require a lower starting height than presses performed in a standing position. Handle 216 comprises a generally U-shaped member 218 having outwardly directed grips 220 rotatably mounted thereon. Horizontal bars or struts 222 and 224 interconnect the legs of U-shaped member 218 to reinforce the handle assembly. Strut 224 is bolted in place so that it can be removed for clearance when performing bench presses, and reinstalled for engagement by the shoulders when performing squat exercises or by the feet when performing leg presses. The bottom portion 226 of U-shaped member 218 is provided with two projecting apertured tabs 228 (FIG. 9). Tabs 228 are receivable in slots 230 formed in the front face 204 of carriage 202. Several different pairs of slots 230 are provided at different heights along carriage 202. Apertures 232 in tabs 228 are keyed, as are apertures 234 formed in side members 206 adjacent each pair of slots 230. When tabs 228 are inserted in slots 230, apertures 232 and 234 are aligned to receive a keyed locking pin 236 which is inserted from one side of carriage 202 and extends the full width thereof to lock handle 216 in position. Preferably the keyways formed in apertures 234 are at the twelve o'clock and six o'clock positions, while the key 237 on locking pin 236 is disposed 90 degress from the pin's handle portion 239. This arrangement requires rotation of the locking pin 236 to effect full engagement, but will prevent inadvertent dislodging of the locking pin during use when handle portion 239 is pointing downwardly.

Preferably tabs 228 are disposed at a small angle with respect to the plane of U-shaped member 218. As illustrated in FIG. 1, this will permit the handle assembly 216 to extend at a slight downward angle with respect to the horizontal, or, with the handle in an inverted position, at a slight upward angle. This feature affords the user a greater selection of starting heights.

A weight support platform 302 (FIGS. 7 and 8) having a rectangular opening 304 is bolted to guide bars 102 by bolts 306 and nuts 308. Platform 302 supports a stack of weights 310 having rectangular apertures 312 in which guide bars 102 are received. Weights 310 also have a generally centrally located circular aperture 314 adapted to receive a weight support rod 316. Rod 316 is pinned through a hole 317 at its upper end (FIG. 6) to the central box-shaped section 315 of a lifting bracket 318 by a pin or bolt 321. Pin 321 extends through holes 319 in the front face 204 of the carriage and in bracket 318. Bracket 318 is secured to side members 206 by bolts 320 or the like. Weight rod 316 is provided with a series of vertically spaced transverse holes 324 (FIG. 7) which are adapted to align with transverse bottom grooves 326 in each weight 310. Selection of weight quantity is accomplished by positioning a pin or rod 328 through the groove 326 of the bottom one of a selected stack of weights through the corresponding aperture 324 in weight rod 316. Hence, elevation of carriage 202 will raise weight rod 316, pin 328 and all weights supported thereabove. Downward movement of weight rod 316 is limited by a recessed stop member 327 pressed, welded, or otherwise secured in an aperture 329 in platform 302.

Figure 11:
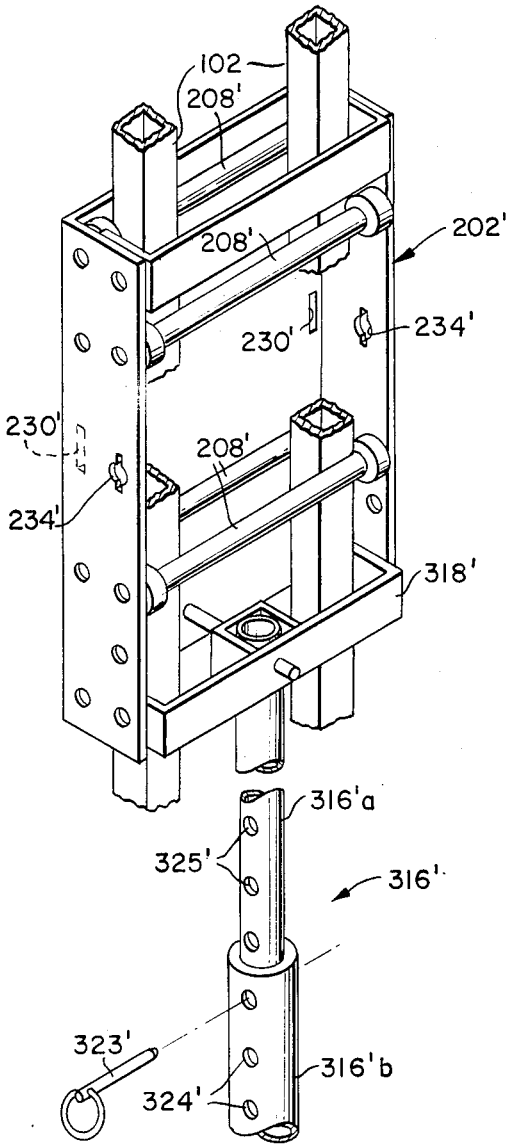
FIG. 11 is an partial perspective view of a modified carriage assembly and weight support rod for the unit.
Figure 12:
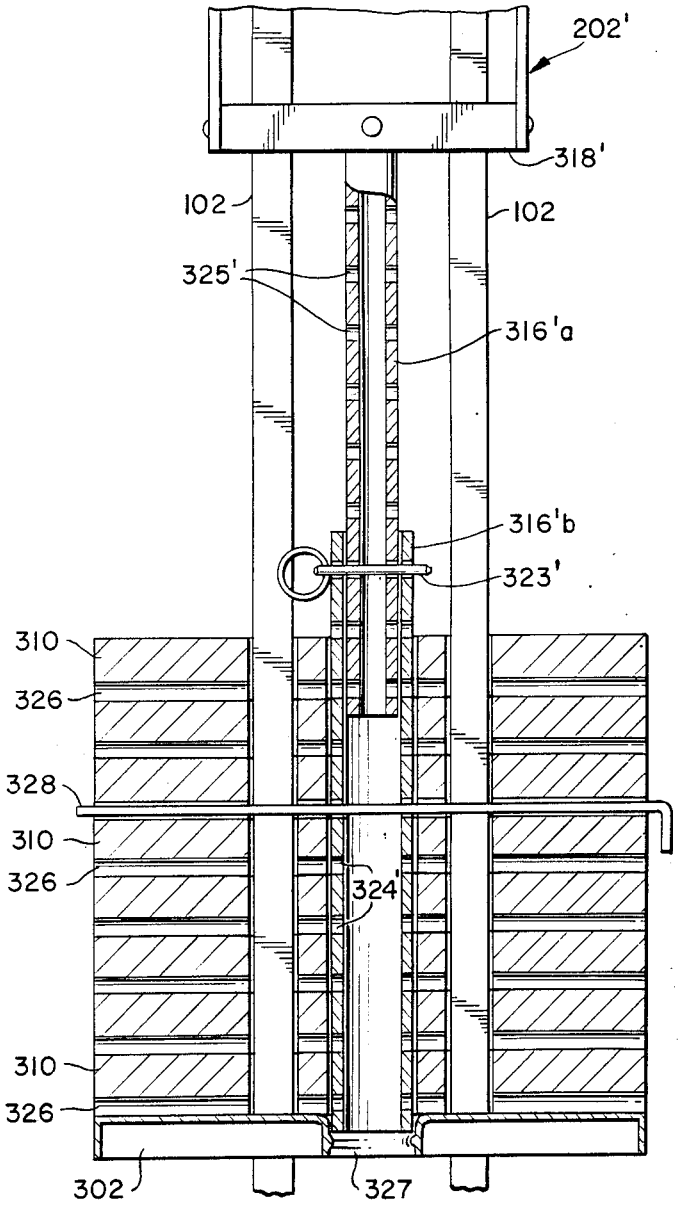
FIG. 12 is a partial rear elevational view of the exercise unit in accordance with the embodiment of FIG. 11.

Another arrangement which can be used to achieve different handle starting heights is illustrated in FIGS. 11 and 12. In this embodiment, a short carriage 202' with rollers 208' has only one pair of handle slots 230' in which handle tabs 228 are received and pinned by locking pin 236 through apertures 234'. A telescoping weight rod 316' has an upper rod portion 361'*a* slidable within a lower rod portion 316'*b*. Lower rod portion 316'*b* has the usual transverse weight pin receiving holes 324'. Upper rod portion 316'*a* has similarly spaced holes 325' which are alignable with holes 324' in lower rod portion 316'*b*. The initial height of carriage 202' and its one-position handle is chosen by elevating carriage 202' to the desired position, and inserting a pin 323' through aligned holes 324' and 325' to lock the telescoping rod portions relative to one another. Pin 323' and holes 324', 325' may be keyed to prevent dislodging of pin 323' during use of the unit.

Various types of weight lifting exercises may also be peformed through the use of a cable and pulley system which may be operatively connected to carriage 202. An upper sheave 330 (FIG. 3) is pivotably attached by a bolt 332, washer 334, and nut 336 to the flat portion 120 of top bracket 114. A carriage sheave 338 is bolted to a U-shaped bracket 340 by bolts 342 and nuts 344. Bracket 340 may be secured to the side members 206 of carriage 202 by a keyed locking pin 346 engageable in aligned keyed apertures 348 and 350, respectively, in bracket 340 and side members 206. A primary cable 352 (FIGS. 1 and 2) has one end 354 anchored to the flat portion 120 of bracket 114 in a keyhole slot 356 (FIG. 3), which is locked by a plug 358 to prevent detachment of cable 352. Cable 352 is trained around carriage sheave 338 and then around upper sheave 330. The opposite end of cable 352 is provided with a quick release coupling 360.

Any suitable handle or grip may be secured to coupling 360 for performing "high pull" weight lifting exercises. Cable 352 may be directed between guide bars 102 so that the pulling force is exerted from a position directly in front of the exercise unit. Or, cable 352 may pass between either guide bar 102 and the wall W by virtue of the pivoted connection of upper sheave 330 so that the weight lifting exercises can be performed at a location to one side of the unit.

"Low pull" exercises may be performed turning upper sheave 330 to the side and by using a secondary cable 362 which is attached to primary cable 352 at coupling 360 and is trained around a lower sheave 364 bolted to the flat portion 140 of lower bracket 134. Cable 362 extends forwardly between guide bars 102 and may be connected to any suitable handle or grip for performing the desired exercises.

A bench B (FIG. 1) may be positioned in front of the exercise unit and used in conjunction therewith for performing various exercises. For example, a user lying on his back on the bench may perform bench presses by repeatedly raising and lowering handle 216. Or, secondary cable 362 may be connected to yet another cable 364 which is attached to a conventional bench-mounted leg lift device 366 via a bench sheave 368 to perform leg lifts and other similar exercises. Preferably, the legs at each end of bench B are foldable so that the bench can be stored compactly. With one set of legs folded, the bench can be used to perform slant board sit-ups.

When not in use, primary cable 352 is coiled manually and retained behind an elastic strap 370 secured to upper bracket 114 by bolts 118 (FIG. 3). Similarly, secondary cable 362 is stored when not in use in a coiled condition beneath elastic strap 372 secured to the side of cover C.

Figure 10:
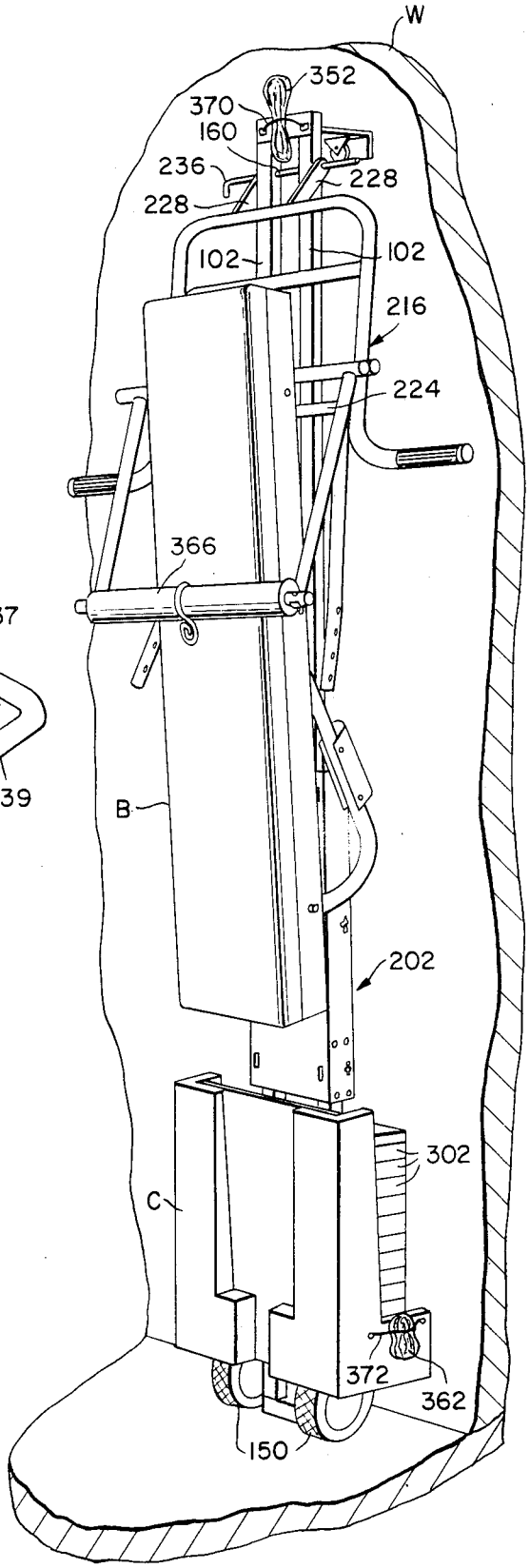
FIG. 10 is a perspective view of the unit shown in its stored position.

When the exercise unit is not in use, but is to be left secured to the wall, handle 216 and bench B may be stored on the unit in a substantially flat configuration by pinning handle 216 through tab apertures 232 to guide bars 102 through holes 160 (FIGS. 1 and 10) with pin 236. The legs of the bench are folded, with the legs at one end hooked over bar 224 of handle 216. This results in a neat and compact exercise unit which may be easily and quickly converted back to its operative configuration.

Holes 160 can also be used to pin carriage 202 in an elevated position through holes 240 in side members 206. With the carriage in this elevated position, bar 224 of handle 216 can be used as a chinning bar or the like.

It will be appreciated that the exercise unit of the invention successfully accomplishes its objectives by virtue of its simplicity, versatility, compactness when folded for storage, and transportability. It is capable of many varied uses for exercising substantially all portions of the body. It is estimated that at least 150 different exercises can be performed using this exercise unit.

It will be obvious to one of ordinary skill that numerous modifications may be made without departing from the true spirit and scope of the invention which is to be limited only by the appended claims.

We claim:

1. In a floor-supported exercise unit adapted to be detachably secured to a wall during use, having floor-engaging support means for supporting the unit, at least one liftable weight, upright guide means for guiding said weight during lifting, and lifting means engageable by a user and operatively connected to said weight for raising and lowering said weight, the improvement comprising lower anchor means, including two mating anchor portions respectively attached to the lower portion of the unit and to a wall, for anchoring the lower portion of the unit to the wall by pivotal movement of the floor-supported unit about said support means upwardly from a slanted position with the lower portion of the unit adjacent the wall and the anchor portions disengaged, to an upright position of use with the anchor portions engaged, and for detaching the lower portion of the unit from the wall by reverse pivotal movement of the unit downwardly from its upright position to disengage said anchor portions.

2. An exercise unit according to claim 1 further comprising upper anchor means for anchoring the upper portion of the unit to the wall after said lower anchor means anchors the lower portion of the unit.

3. An exercise unit according to claim 1 wherein said lower anchor means comprises a wall bracket affixed to the wall having an upwardly directed flange spaced from the wall, and a base bracket affixed to said guide means adjacent the bottom thereof having a depending flange adapted to be received behind said upwardly directed flange when the unit is rotated to its upright position.

4. An exercise unit according to claim 3 wherein said wall bracket is J-shaped.

5. In an exercise unit adapted to be detachably secured to a wall during use, having at least one liftable weight, upright guide means for guiding said weight during lifting, and lifting means engageable by a user and operatively connected to said weight for raising and lowering said weight, the improvement comprising:

wheel means journalled on the unit adjacent the bottom of said guide means for supporting the unit and facilitating transportation thereof when detached from the wall; and lower anchor means attached to the lower portion of the unit for anchoring the lower portion of the unit to the wall by pivotal movement of the unit upwardly about said wheel means from a slanted position with the lower portion of the unit adjacent the wall, to an upright position of use, and permitting detachment of the unit from the wall by reverse pivotal movement of the unit downwardly from its upright position.

6. An exercise unit according to claim 1 further comprising upper anchor means for anchoring the upper portion of the unit to the wall after said lower anchor means anchors the lower portion of the unit.

7. An exercise unit according to claim 1 wherein said lower anchor means comprises a wall bracket adapted to be affixed to the wall having an upwardly directed flange spaced from the wall, and a base bracket affixed to said guide means adjacent the bottom thereof having a depending flange adapted to be received behind said upwardly directed flange when the unit is rotated to its upright position.

8. An exercise unit according to claim 7 wherein said wall bracket is J-shaped.

9. In an exercise unit having at least one liftable weight, lifting means engageable by a user including a liftable carriage operatively connected to said weight for raising and lowering said weight, and upright guide means for guiding said weight and said carriage during lifting, the improvement wherein said guide means comprises two spaced parallel guide bars, each of said guide bars having separate upper and lower bar sections, and coupling means interconnected said guide bars and joining said upper and lower bar sections.

10. An exercise unit according to claim 9 wherein said guide bars have substantially continuous front and rear surfaces along the portion of their length which guides said weights and said carriage, and said carriage engages and is guided by said front and rear surfaces of said guide bars.

11. An exercise unit according to claim 10 wherein said carriage includes front and rear rollers respectively engaging said front and rear surfaces of said guide bars.

12. In a wall-mounted exercise unit having a liftable weight, lifting means engageable by a user including a liftable carriage operatively connected to said weight for raising and lowering said weight, and upright guide means securable to a wall for guiding said weight and said carriage during lifting, said lifting means including an upper sheave mounted near the top of said guide means adapted to guide a cable operatively connected to said carriage so that a high pulling force can be exerted on the cable from the front of the unit to lift said weight, and a lower sheave mounted near the bottom of said guide means adapted to guide said cable so that a low pulling force can be exerted on the cable from the front of the unit, the improvement wherein said cable and said upper and lower sheaves are located adjacent the wall and completely behind said carriage and said guide means, said guide means comprises two spaced parallel guide bars, said upper sheave is pivotally mounted to the unit about a vertical axis substantially medially of said guide bars to permit the cable to be pulled away from and at various angles to the wall including directly out of the front of the unit between said guide bars, and said lower sheave is mounted medially of said guide bars so that said cable can extend therefrom away from the wall between said guide bars.

* * * * *